US006985127B1

(12) United States Patent
Russell et al.

(10) Patent No.: US 6,985,127 B1
(45) Date of Patent: Jan. 10, 2006

(54) PROGRAMMABLE GRAY-SCALE LIQUID CRYSTAL DISPLAY

(75) Inventors: Stephen D. Russell, San Diego, CA (US); Randy L. Shimabukuro, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/518,051

(22) Filed: Aug. 22, 1995

Related U.S. Application Data

(63) Continuation-in-part of application No. 08/301,170, filed on Sep. 1, 1994, now abandoned.

(51) Int. Cl.
*G09G 5/00* (2006.01)

(52) U.S. Cl. ..... 345/89; 345/147; 345/214

(58) Field of Classification Search ..... 345/87–89, 345/214, 904, 147; 349/33, 85–87; 347/130; 148/1.5, 175
See application file for complete search history.

(56) References Cited

U.S. PATENT DOCUMENTS

| | | | | |
|---|---|---|---|---|
| 4,177,084 A | * | 12/1979 | Lau et al. | 148/1.5 |
| 4,443,065 A | | 4/1984 | Funada et al. | |
| 4,541,691 A | | 9/1985 | Buzak | |
| 4,770,500 A | | 9/1988 | Kalmanash et al. | |
| 4,826,300 A | | 5/1989 | Efron et al. | |
| 4,927,240 A | | 5/1990 | Stolov et al. | |
| 5,035,489 A | | 7/1991 | Iijima et al. | |
| 5,044,732 A | | 9/1991 | Kimura et al. | |
| 5,062,690 A | * | 11/1991 | Whetten | 345/87 |
| 5,089,810 A | | 2/1992 | Shapiro et al. | |
| 5,090,794 A | | 2/1992 | Hatano et al. | |
| 5,103,328 A | | 4/1992 | Numao | |
| 5,178,955 A | * | 1/1993 | Aharoni et al. | 428/421 |
| 5,196,839 A | * | 3/1993 | Johary et al. | |
| 5,489,918 A | * | 2/1996 | Mosier | 345/89 |
| 5,504,514 A | * | 4/1996 | Nelson | 347/130 |
| 5,598,179 A | * | 1/1997 | Orlen et al. | 345/98 |
| 5,640,171 A | * | 6/1997 | Shimada | 345/8 |
| 5,680,185 A | * | 10/1997 | Kobayashi et al. | 349/88 |
| 5,680,192 A | * | 10/1997 | Burrell et al. | 349/152 |
| 5,774,254 A | * | 6/1998 | Berlin | 359/259 |
| 5,790,297 A | * | 8/1998 | Berlin | 359/259 |
| 5,815,303 A | * | 9/1998 | Berlin | 359/214 |
| 6,043,797 A | * | 3/2000 | Clifton et al. | 345/589 |
| 6,329,964 B1 | * | 12/2001 | Tanaka | 345/8 |

(Continued)

FOREIGN PATENT DOCUMENTS

EP 0 423 887 * 4/1991

(Continued)

*Primary Examiner*—Amare Mengistu
(74) *Attorney, Agent, or Firm*—Peter A. Lipovsky; Michael A. Kagan; Allan Y. Lee

(57) ABSTRACT

A programmable gray-scale liquid crystal display comprises a polarizer operably coupled to a beam of incident light to pass a beam of polarized light having a polarization axis. A sequence of liquid crystal display pixels serially aligned with the beam of polarized light controls the angle of the polarization axis. An analyzer passes a gray-scale portion of the beam of polarized light from the sequence of liquid crystal display pixels corresponding to the angle of the polarization axis. Each pixel in the sequence may be independently programmed to vary the angle of the polarization axis for calibrating the display to a standard gray-scale and for correcting faulty pixels with VLSI on-chip driver and interface circuits.

2 Claims, 9 Drawing Sheets

U.S. PATENT DOCUMENTS

| | | | | |
|---|---|---|---|---|
| 6,611,249 | B1 * | 8/2003 | Evanicky et al. | 345/102 |
| 2002/0130830 | A1 * | 9/2002 | Park | 345/99 |
| 2003/0184738 | A1 * | 10/2003 | Yamaguchi | 356/213 |

FOREIGN PATENT DOCUMENTS

| | | | |
|---|---|---|---|
| WO | WO 94/08331 | * | 4/1994 |

* cited by examiner

PROGRAMMABLE GRAY-SCALE LIQUID CRYSTAL DISPLAY

CROSS REFERENCE TO RELATED APPLICATIONS

This application is a continuation-in-part under 37 CFR 1.53 of U.S. patent application Ser. No. 08/301,170, filed on Sep. 1, 1994 now abn. "Electrically Addressable Silicon-On-Sapphire Light Valve", R. L. Shimabukuro et al.

BACKGROUND OF THE INVENTION

The present invention relates to liquid crystal displays formed on silicon-on-sapphire. More specifically, but without limitation thereto, the present invention relates to a liquid crystal display integrated with electronic circuitry on the display to provide a programmable gray-scale and to compensate for nonuniform and non-operating pixels in the display.

Liquid crystal displays (LCDs) are used in a wide variety of commercial applications, including portable and laptop computers, wristwatches, camcorders, and television screens. Inherent limitations of existing technology arise from the necessity of fabricating LCDs on transparent glass or quartz substrates which are not amenable to processing with high quality electronic materials.

The integration of drive circuitry with LCDs has improved reliability and reduced size and weight for portable applications, but has been limited to thin film transistor technology using, for example, amorphous (α-Si) and polycrystalline (poly-Si) silicon deposited on glass and quartz substrates.

Lattice and thermal mismatch between layers and low temperature deposition methods used in thin film transistor technology result in a silicon layer with poor charge carrier mobility and crystallographic defects which are directly related to electronic device performance and limitations. A comparison of MOS technologies for active matrix LCDs is shown in the following table:

| | POLY-TFT HT-CMOS | POLY-TFT MT-CMOS | α-Si:H NMOS | CMOS UTSOS |
|---|---|---|---|---|
| 1. Substrate | fused quartz | hard glass | hard glass | $Al_2O_3$ |
| 2. Max. process temp | ~1000° C. | 600° C. | 300° C. | 1000° C. |
| 3. Threshold (Volts)(n-chnl) | 2.0 | 2.0 | 1.5 | 0.5 |
| 4. Mobility | 100 | 40 | 0.75 | 380 |
| 5. Shift register | 20 MHz @15 V | 5 MHz @15 V | 0.1 MHz @15 V | >100 MHz @5 V |
| 6. Integrated LSI logic | N/A | N/A | N/A | yes |

For ultra-high resolution display applications, the high density of LSI circuitry is of particular importance for integrated displays. Compatibility with Very Large Scale Integration (VLSI) allows integration on-chip of video drivers, digital logic, compensating or fault-tolerant circuitry, and other computational circuitry, thereby providing greater functionality, higher reliability, and improved performance. A need thus exists for a material quality that overcomes the problems which occur in small scale, high density circuitry fabricated in α-Si and poly-Si.

A need also exists for multiple level gray-scale and color displays for the applications mentioned above. Color displays have been made with colored filters by incorporating dyes into a guest host matrix, or by using field sequential color techniques. Color liquid crystal displays may also be made using the gray-scale properties of a liquid crystal display to achieve variations in color.

While the optical, electrical, and electro-optical properties of the liquid crystal material primarily determine the gray-scale properties, the substrate plays a significant role in the pixel uniformity of the display. Substrate warpage, or variations in surface morphology, can lead to variations in thickness of the liquid crystal layer. This in turn may lead to a nonuniform display intensity for a given pixel voltage, which is a problem for multiple gray-scale displays, high density displays, and displays having stringent operating requirements. Furthermore, for high brightness displays, substantial heating may occur which can not be readily dissipated through substrates such as glass or quartz.

Prior research on brightness nonuniformity of LCDs established another cause of display nonuniformity, specifically the high resistance of narrow electrodes in high density LCDs.

A related problem particularly important for displays having stringent specifications is fault tolerance, or recovering from failed pixels. This problem is not emphasized in an LCD market primarily interested in low cost commercial applications, but becomes significant in high-reliability technology.

Another problem is that as display resolutions increase, the number of switching elements required in active matrix displays increases. A higher number of switching elements causes yield problems in manufacturing and in reliability. Fabrication yields of nonlinear switching elements (thin film transistors or diodes) may be improved by redundancy, but the redundancy applies only to the switching element rather than for the entire pixel.

SUMMARY OF THE INVENTION

The programmable gray-scale LCD of the present invention is directed to overcoming the problems described above, and may provide further related advantages. The following description of a programmable gray-scale LCD does not preclude other embodiments and advantages of the present invention that may exist or become obvious to those skilled in the art.

A programmable gray-scale liquid crystal display comprises a polarizer operably coupled to a beam of incident light to pass a beam of polarized light having a polarization axis. A sequence of liquid crystal display pixels serially aligned with the beam of polarized light controls the angle of the polarization axis. An analyzer passes a gray-scale portion of the beam of polarized light from the sequence of liquid crystal display pixels corresponding to the angle of the polarization axis. Each pixel in the sequence may be independently programmed to vary the angle of the polarization axis for calibrating the display to a standard gray-scale and for correcting faulty pixels with VLSI on-chip driver and interface circuits.

One advantage of the programmable gray-scale LCD is that it provides a gray-scale with high resolution.

Another advantage is that multiple level gray-scale and color displays may be made according to the present invention.

Still another advantage is that failed pixels may be corrected by reprogramming the display.

Yet another advantage is that the gray-scale of the display may be programmed to conform to a gray-scale standard.

Another advantage is that a plurality of liquid crystal pixels are concatenated to form a display having a gray-scale that is programmable and fault-tolerant.

The features and advantages summarized above in addition to other aspects of the present invention will become more apparent from the description, presented in conjunction with the following drawings.

DESCRIPTION OF THE INVENTION

The following description is presented solely for the purpose of disclosing how the present invention may be made and used. The scope of the invention is defined by the claims.

Figure 1:
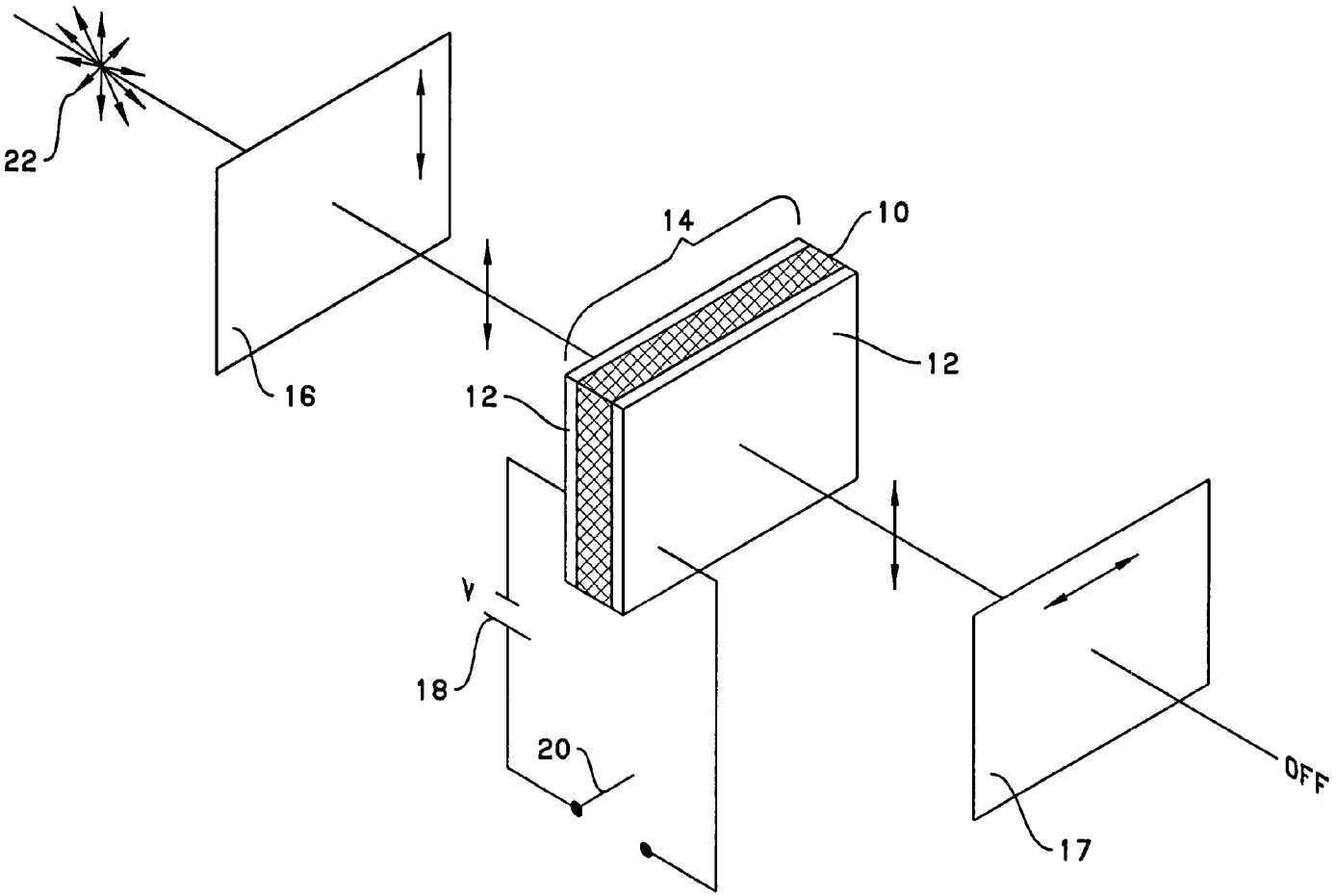
PRIOR ART FIG. 1
FIG. 1 is a diagram of an example in the prior art of a liquid crystal display pixel in the non-transmissive or OFF state.
Figure 2:
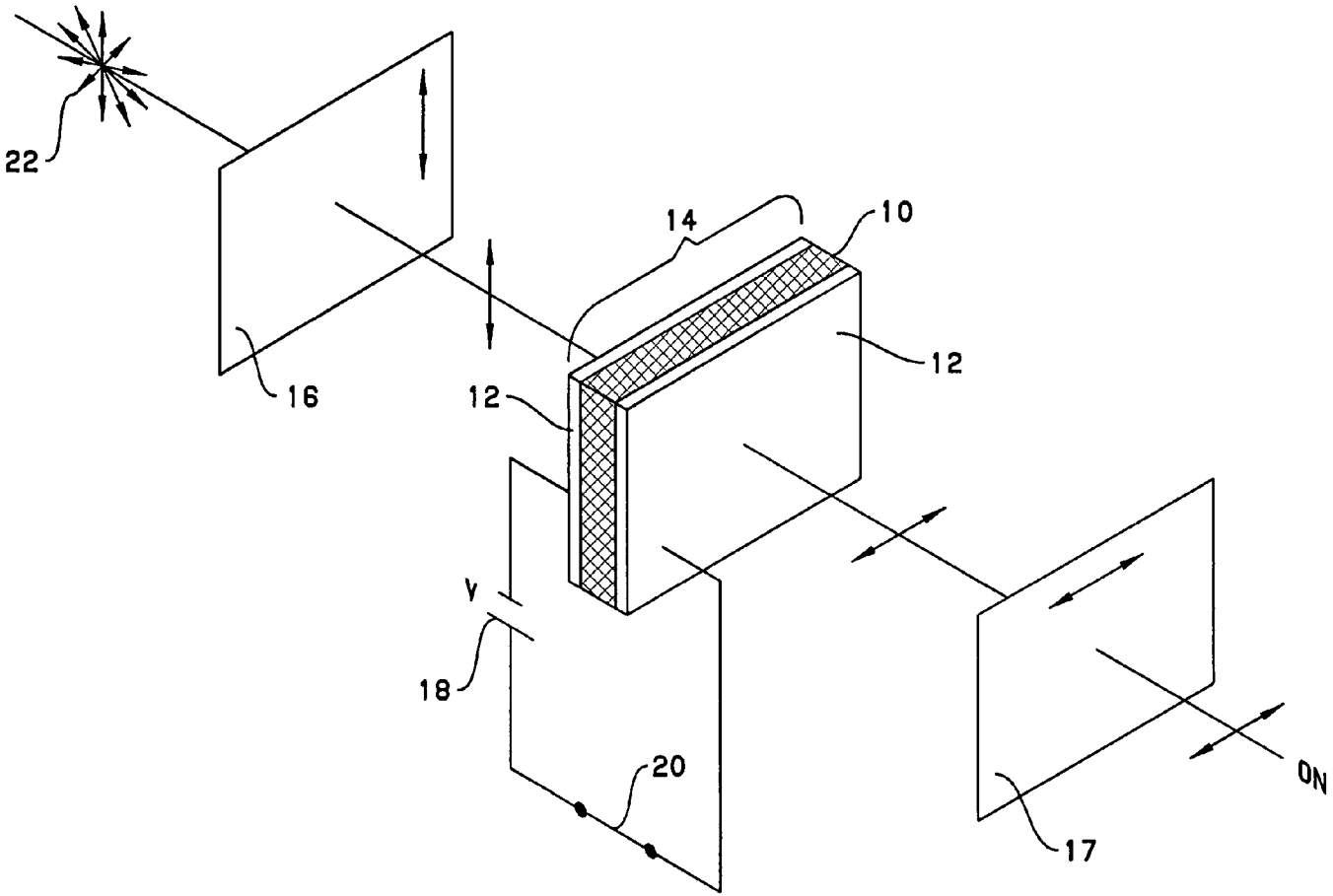
PRIOR ART FIG. 2
FIG. 2 is a diagram of the liquid crystal display pixel of FIG. 1 in the transmissive or ON state.
Figure 3:
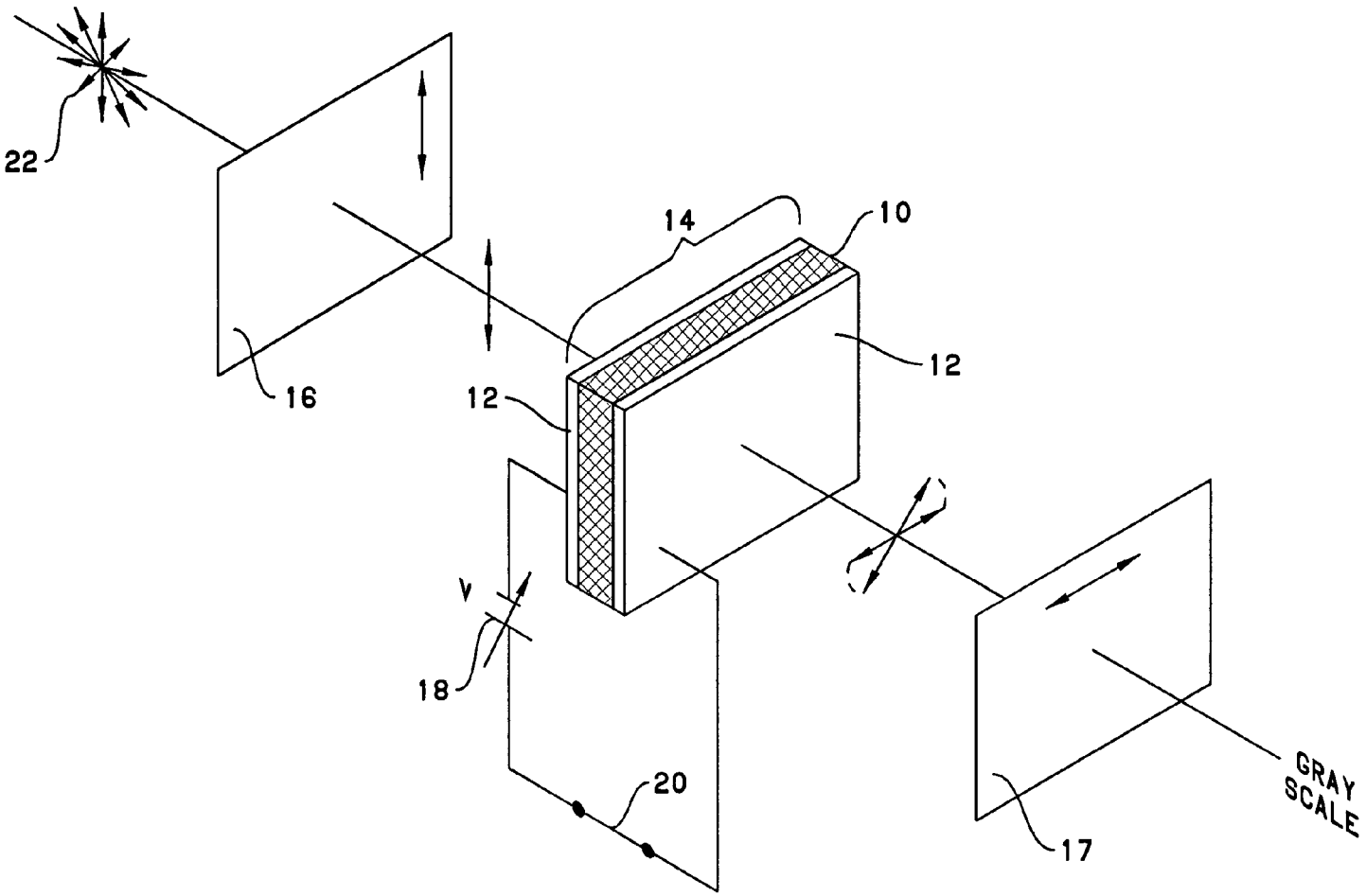
PRIOR ART FIG. 3
FIG. 3 is a diagram of the liquid crystal display pixel of FIG. 1 with gray-scale control.

FIGS. 1–3 are diagrams illustrating an example of liquid crystal display (LCD) gray-scale as currently practiced. In FIG. 1, a liquid crystal medium 10 is contained within transparent electrodes 12 to form a pixel element 14. Pixel element 14 is then placed between a polarizer 16 and an analyzer 17. Analyzer 17 polarizes light in a direction orthogonally oriented with polarizer 16. When unpolarized light from a light source 22 passes through polarizer 16, transparent electrodes 12, and liquid crystal medium 10, the light becomes polarized and is absorbed by analyzer 17. Pixel element 14 consequently appears OFF or opaque.

In FIG. 2, closing a switch 20 causes the application of a voltage V from a voltage source 18 to transparent electrodes 12. Voltage V causes the orientation of liquid crystal medium 10 to change, which rotates the polarization axis of the light from light source 22 passing through polarizer 16. The rotated polarization axis allows the light to pass through analyzer 17. Pixel element 14 consequently appears ON or transparent.

In FIG. 3, voltage V is varied to vary the rotation of the polarization axis of the light from light source 22. The percentage of light from light source 22 passing through analyzer 17 may thus be controlled, resulting in a gray-scale varying from transparent to opaque. Typical LCDs are fabricated from a plurality of pixel elements 14, usually in a two-dimensional array or display area. A variation of this concept includes the design of pixel elements in a liquid crystal medium that are in the OFF state or opaque when there is no voltage applied to the transparent electrodes. Another variation uses bistable ferroelectric liquid crystals (FLCs), which have a continuously variable polarization with application of a voltage. FLC's may exhibit a gray scale by rapidly switching the pixels to allow a time averaged optical state which corresponds to a gray level. When used for color generation, the FLC pixel switching is correlated with the desired wavelength of light. This method is referred to as field sequential color.

The embodiment described herein pertains to nematic liquid crystals, however FLC's, supertwisted nematic, and the like may also be used to practice the present invention.

Figure 3A:
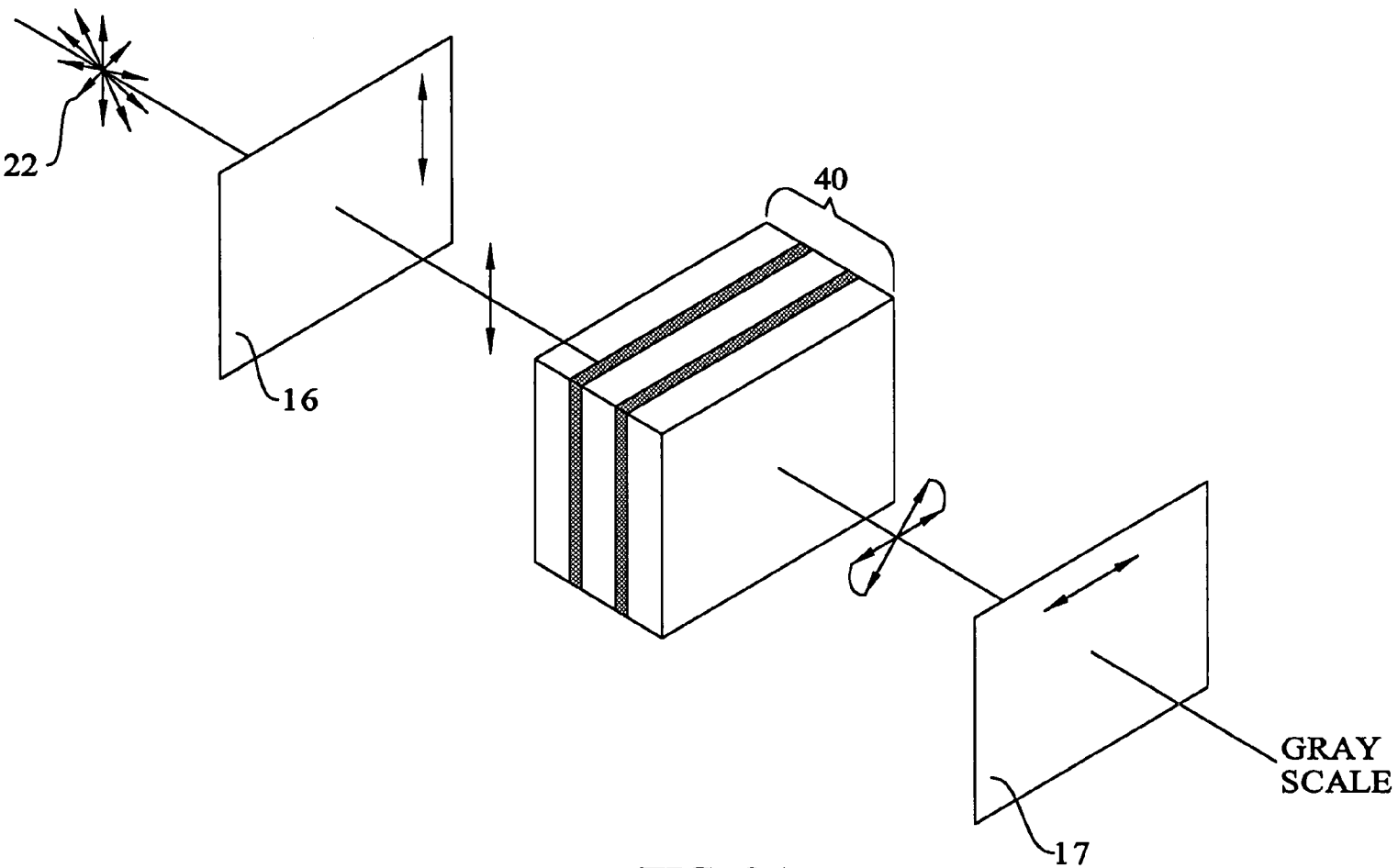
FIG. 3A illustrates the programmable gray-scale LCD of the present invention in a typical configuration including a polarizer and an analyzer.
Figure 4:
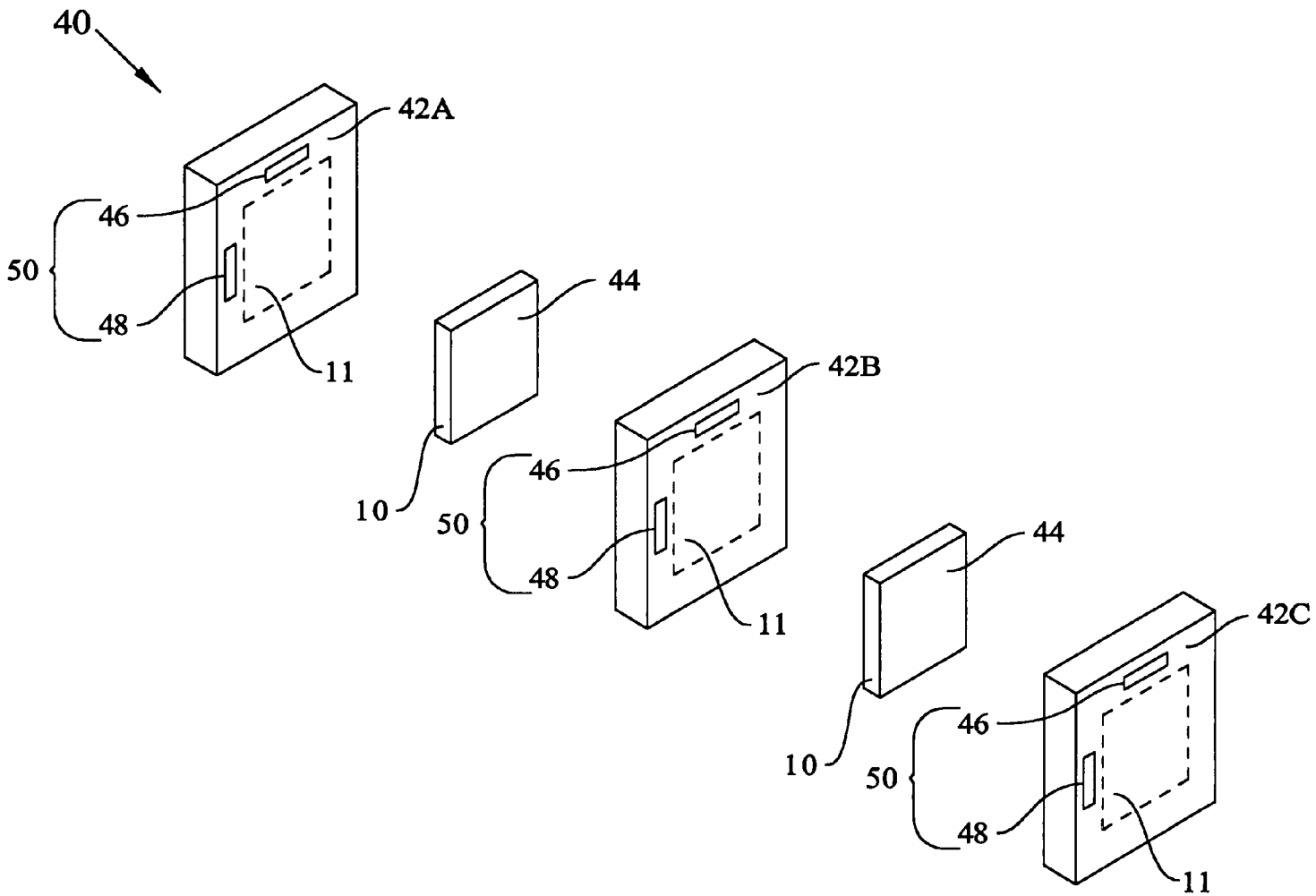
FIG. 4 is an exploded view diagram of a programmable gray-scale LCD of the present invention.

FIG. 4 is a diagram of a fault tolerant, programmable gray-scale LCD 40 of the present invention with silicon-on-sapphire (SOS) technology to provide the advantage of VLSI compatibility. In this exploded view, spacers 44 form a cavity between SOS wafers 42. Pixel element electrodes are formed in SOS wafers 42A, 42B, and 42C. SOS wafers 42A, 42B, and 42C are referred to collectively as SOS wafers 42. The cavity formed by SOS wafers 42 and spacers 44 are filled with an appropriate liquid crystal material 10, such as nematic, supertwisted nematic or ferroelectric liquid crystals, and interposed between SOS wafers 42. Exemplary techniques for fabricating SOS wafers 42 are described by S. S. Lau et al in U.S. Pat. No. 4,177,084, "Method For Producing a Low Defect Layer of Silicon-on-Sapphire Wafer", incorporated herein by reference thereto. SOS wafers 42 provide drive control and pixel electrodes for liquid crystal material 10. Each of SOS wafers 42 may be fabricated independently and joined in the final steps of fabrication. The combination of spacers 44 and SOS wafers 42 results in a serial arrangement of pixels in optically coupled independent displays. In this arrangement, two or more pixels are collinear with a straight line passing through the optical axis of programmable gray-scale LCD 40, so that a beam of polarized light passes through a sequence of serially aligned pixels. The pixels may be individually programmed calibrate a uniform gray-scale and to provide redundancy for replacing faulty pixels. Interface circuitry 46 and electronically programmable driver circuitry 48 may be formed on SOS wafers 42 according to well known techniques to provide gray-scale control 50. Programmable gray-scale LCD 40 may be applied to the typical configuration of FIG. 3 with polarizer 16 and analyzer 17 as shown in FIG. 3A.

Figure 5:
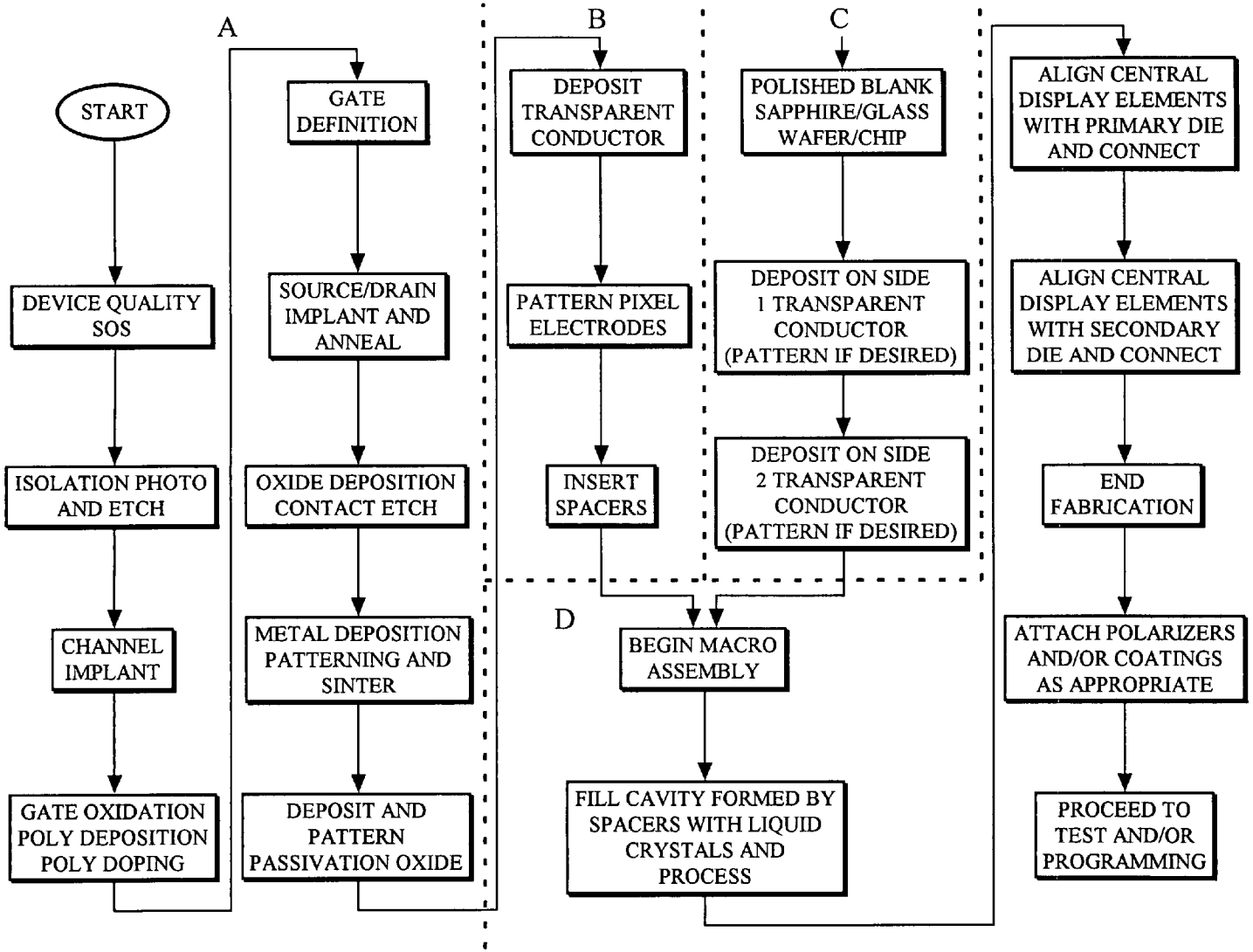
FIG. 5 is a flow chart of the method of the present invention for fabricating the LCD of FIG. 4.

FIG. 5 is a flow chart of the process for fabricating LCD 40. Portion "A" lists the order of steps in the fabrication of SOS wafers 42 comprising the integrated drive control and pixel electrode circuitry. The drive control electronics may include circuitry to detect failure conditions in the display, to calibrate the display gray-scale, or to switch to alternative pixel configurations for replacing defective pixels. The circuitry need not be identical on each of SOS wafers 42, but preferably includes common drive and interface circuitry indicated in FIG. 4 as 46 and 48 respectively. Portion "B" of FIG. 5 describes the fabrication of the pixel electrodes on SOS wafers 42A and 42C and insertion of spacers 44.

Portion "C" of FIG. 5 lists the order of steps for fabricating the pixel electrodes on SOS wafer 42B.

Portion "D" of FIG. 5 lists the order of steps for joining SOS wafers 42 and spacers 44 to form LCD 40.

Referring now to FIGS. 4 and 5, SOS wafers 42A and 42C in FIG. 4 are formed of device quality silicon-on-sapphire. Well known techniques are used to form VLSI circuitry (not shown) in the steps of isolation photo and etch, channel implant, gate oxidation, poly deposition and doping, gate definition, source/drain implant and annealing, oxide deposition and contact etch, metal deposition, patterning, and sintering, and deposition and patterning of passivation oxide. The VLSI circuitry may be formed on SOS wafers 42 outside of a display region 11.

A transparent conductor, such as indium tin oxide, tin oxide, or polysilicon is deposited on substrates 42A and 42C in display region 11 and pixel electrodes (not shown) are patterned according to well known techniques. Spacers 44, schematically shown in FIG. 4, are then attached to substrates 42B and 42C. Spacers 44 may be, for example, glass beads randomly distributed on the substrate.

A transparent conductor is deposited on opposite sides of a polished blank sapphire wafer or alternately glass, quartz or other transparent material to form SOS wafer 42B. The transparent conductor may then be patterned and formed into pixel electrodes (not shown).

Spacers 44 are inserted to form cavities on SOS wafers 42. The cavities are then filled with liquid crystal material 10. The pixel elements on each of display regions 11 of SOS wafers 44 are serially aligned to form pixel sequences, and SOS wafers 42 and spacers 44 are assembled into a single structure. The assembly of LCD 40 is completed with the addition of polarizer 16 and analyzer 17 of FIG. 1 using techniques well known to those skilled in the art.

Figure 6:
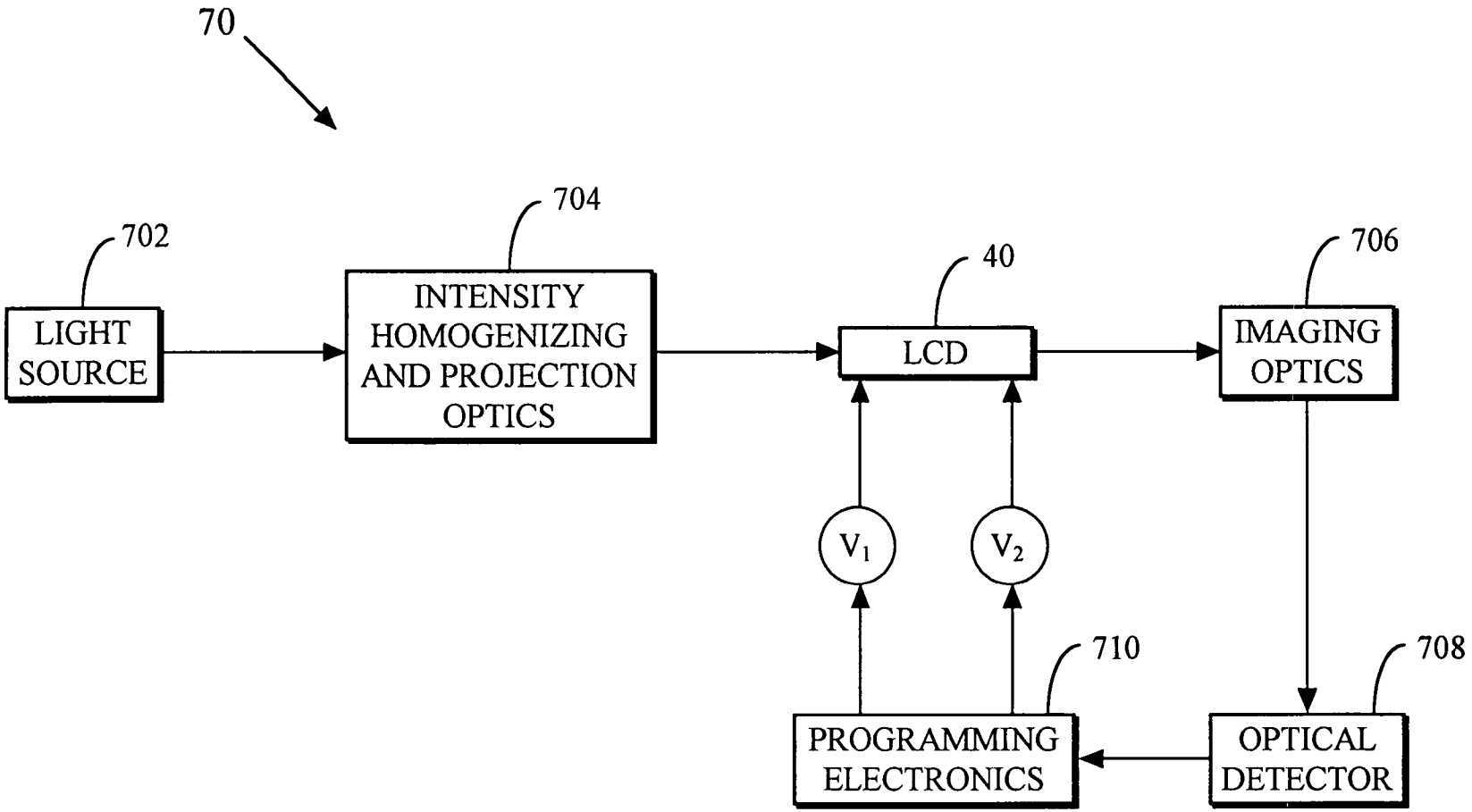
FIG. 6 is a block diagram of an optical testbed used for programming the LCD of FIG. 4.

LCD 40 may be programmed and calibrated in an optical test bed 70 as shown in the block diagram of FIG. 6. A light source 702 transmits a beam of light having a spatially uniform intensity pattern through intensity homogenizing and projection optics 704 to LCD 40. The light passed by LCD 40 is focused by imaging optics 706 and measured by an optical detector 708. Programming electronics 710 adjusts programming voltages $V_1$ and $V_2$ to vary the gray-scale to a desired value as measured by optical detector 708 for each pixel sequence of LCD 40.

Figure 7:
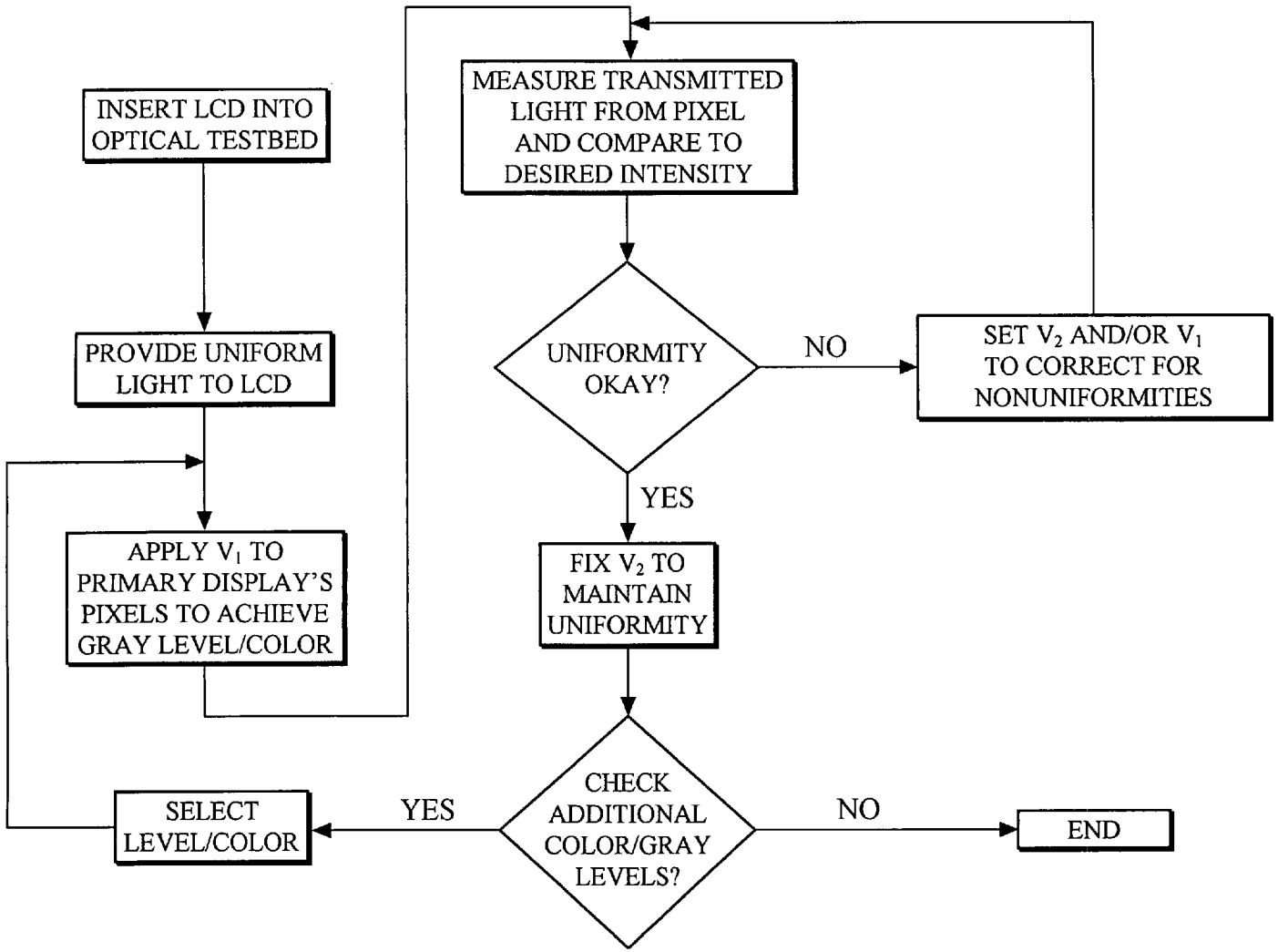
FIG. 7 is a flow chart of gray-scale calibration programming of the LCD of FIG. 4 in the test bed of FIG. 6.

FIG. 7 is a flow chart of a program for calibrating LCD 40 to a standard gray-scale. LCD 40 is placed into optical test bed 70 of FIG. 6 and subjected to light from light source 702. Voltage $V_1$ is applied to a pixel of one of the independent displays of LCD 40 corresponding to a gray-scale or color value. The percentage of light passed through the selected pixel is measured by optical detector 708 and compared to a standard. If the measured value is within tolerance of the standard value, voltage $V_2$ is fixed to maintain the calibrated pixel intensity and voltage $V_1$ is applied to another pixel sequence. If the measured value lies outside the tolerance of the standard value, $V_2$ and/or $V_1$ may be adjusted to vary the percentage of light passed to optical detector 708 until the measured value is within tolerance. Each row and column of LCD 40 may be calibrated in a similar manner. After LCD 40 has been calibrated for one gray-scale level or color, another level or color is selected and the calibration is repeated until all rows and columns of LCD 40 are calibrated for all gray-scale levels or colors of the standard.

Figure 8:
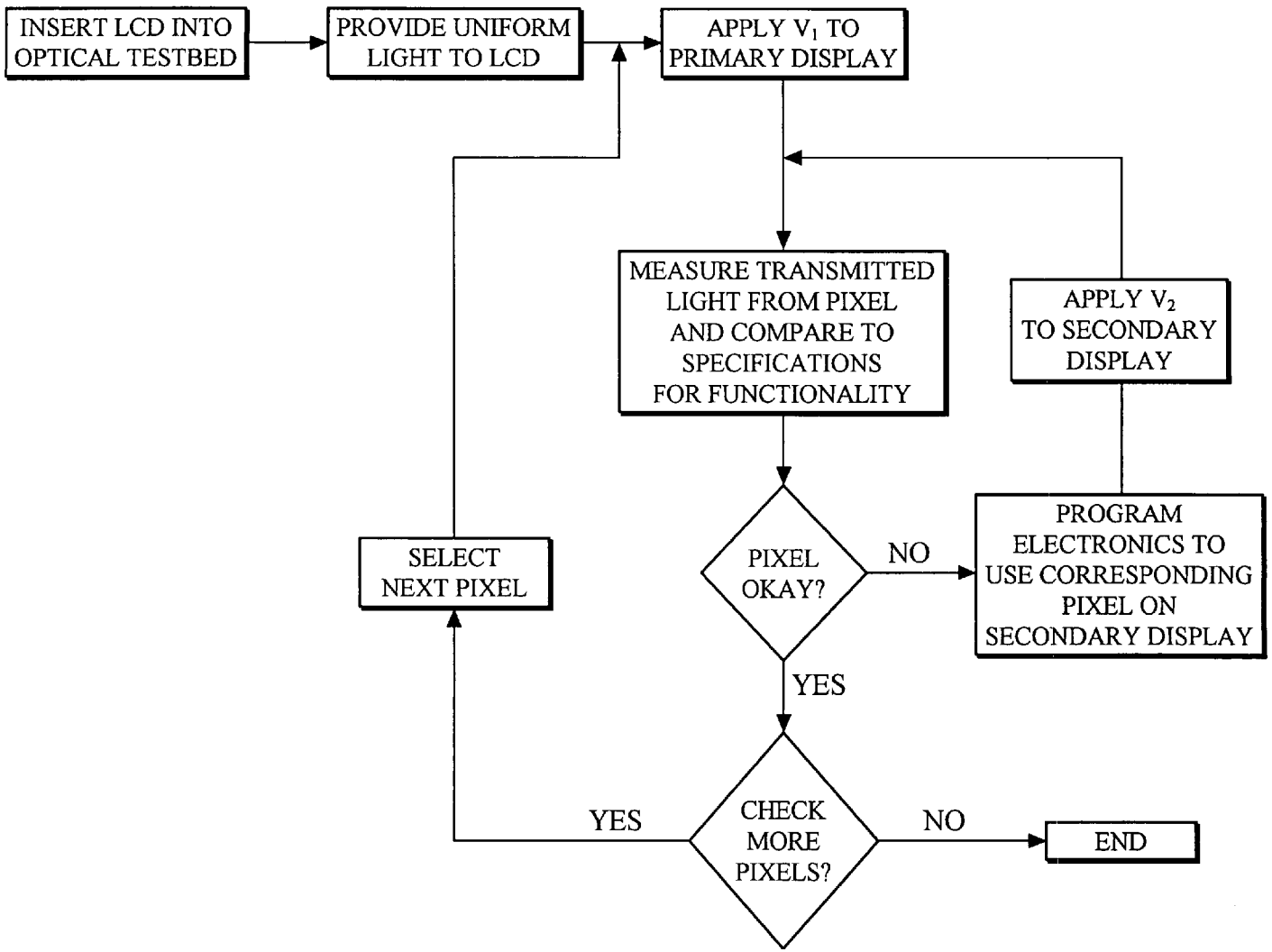
FIG. 8 is a flow chart of fault tolerance programming of the LCD of FIG. 4 in the test bed of FIG. 6.

FIG. 8 is a flow chart of a program for correcting faulty pixels. LCD 40 is placed into optical test bed 70 of FIG. 6 and subjected to light from light source 702. While Voltage $V_1$ is applied to a pixel in a pixel sequence of LCD 40, the light passing through the pixel is measured and compared with a standard value. If the measurement falls outside the specification tolerance, voltage $V_2$ is applied to another pixel in the pixel sequence. Voltage $V_2$ is then adjusted in increments until the measured light passing through the pixels falls within the specified tolerance. Once the desired value is achieved, $V_2$ is fixed for the corresponding pixel. Each pixel in the display area may be similarly calibrated.

Monolithically integrated, i.e. on-chip, VLSI circuitry may be fabricated according to well-known techniques outside region 11 of SOS wafers 42 in FIG. 4. The VLSI circuitry may include memory circuits such as static random access memory (SRAM), dynamic RAM (DRAM), and non-volatile RAM (NVRAM) to store the calibration information obtain through the processes described in FIG. 7 and FIG. 8.

Other modifications, variations, and applications of the present invention may be made in accordance with the above teachings other than as specifically described to practice the invention within the scope of the following claims.

We claim:

1. A method for calibrating a fault tolerant liquid crystal display comprising the steps of:

placing a fault tolerant liquid crystal display into an optical test-bed, wherein the liquid crystal display includes a primary liquid crystal display region and least one secondary liquid crystal display region, each liquid crystal display region containing an array of pixels;

uniformly illuminating each of the pixels on the liquid crystal display regions; determining a desired light intensity through each of the pixels on the liquid crystal display regions;

determining a desired uniformity level for the liquid crystal display;

applying a first voltage to the pixels of the primary liquid crystal display region and applying a second voltage to the pixels of the secondary liquid crystal display region to achieve a transmitted light intensity;

measuring the transmitted light intensity through each of the pixels on the liquid crystal display regions;

comparing the transmitted light intensity with the desired light intensity;

adjusting the first voltage or the second voltage to achieve the desired light intensity and the desired uniformity; and fixing the adjusted first voltage and adjusted second voltage to maintain the desired light intensity and the desired uniformity.

2. A method for correcting faulty pixels in a fault tolerant liquid crystal display comprising the steps of:

placing a fault tolerant liquid crystal display into an optical test bed, wherein the liquid crystal display includes a primary liquid crystal display region and least one secondary liquid crystal display region, each liquid crystal display region containing an array of pixels;

uniformly illuminating each of the pixels on the liquid crystal display regions;

determining a desired light intensity through each of the pixels on the liquid crystal display regions;

applying a first voltage to the pixels of the primary liquid crystal display region and applying a second voltage to the pixels of the secondary liquid crystal display region to achieve a transmitted light intensity;

measuring the transmitted light intensity through each of the pixels on the liquid crystal display regions;

comparing the transmitted light intensity with the desired light intensity;

adjusting the first voltage or the second voltage to achieve the desired light intensity, and fixing the adjusted first voltage and adjusted second voltage to maintain the desired light intensity.

* * * * *